US006138828A

United States Patent [19]

Bendix

[11] Patent Number: 6,138,828

[45] Date of Patent: Oct. 31, 2000

[54] PRODUCE PACKAGE AND DISPLAY PARTICULARLY FOR FRESH HERBS

[75] Inventor: Michael Livingston Bendix, Malibu, Calif.

[73] Assignees: McCormick & Company, Inc., Sparks, Md.; Malibu Farms, Commerce, Calif.

[21] Appl. No.: 09/303,612

[22] Filed: May 3, 1999

[51] Int. Cl.[7] ..... B65D 85/50

[52] U.S. Cl. ..... 206/423; 206/459.5

[58] Field of Search ..... 206/423, 426, 206/459.5; 40/645; 47/84; 53/397, 399

[56] References Cited

U.S. PATENT DOCUMENTS

| | | | |
|---|---|---|---|
| 2,750,138 | 6/1956 | Morris | 206/423 |
| 3,142,133 | 7/1964 | Brooks | 206/423 |
| 3,259,236 | 7/1966 | Cole | 206/423 |
| 3,810,329 | 5/1974 | Lecuru et al. | 206/423 |
| 4,420,903 | 12/1983 | Ritter et al. | 47/84 |
| 4,811,841 | 3/1989 | Domenichiello | 206/423 |
| 5,311,991 | 5/1994 | Weder et al. | 206/423 |
| 5,687,502 | 11/1997 | Weder | 206/423 |

OTHER PUBLICATIONS

"Packaging Innovations Abound at the Supermarket Convention", Food & Drug Packaging, Jun. 1999; p. 8.

*Primary Examiner*—Paul T. Sewell
*Assistant Examiner*—Luan K. Bui
*Attorney, Agent, or Firm*—Oblon, Spivak, McClelland, Maier & Neustadt, P.C.

[57] ABSTRACT

A plant item package which includes a vessel portion and a lid with an opening. The vessel portion may be at least partially filled with water. Stems of plant items, e.g. herbs, are passed through the opening of the lid and into the water of the vessel. Placing herbs in the vessel maintains the freshness of the herbs, eliminates shrinkage of the herbs, eliminates refrigeration requirements, and increases the shelf life of the herbs. Further, the herbs can continue to grow in the water filled vessel. A cellophane wrapping may also be placed around the herbs outside of the vessel. The herbs can thus be sold in predetermined amounts, and price and/or identification information can be placed on a label placed on one of the wrapping or vessel. Further, a plurality of the vessels can be inserted into a shipping container which can also be used as a display for the vessels.

41 Claims, 2 Drawing Sheets

PRODUCE PACKAGE AND DISPLAY PARTICULARLY FOR FRESH HERBS

BACKGROUND OF THE INVENTION

1. Field of the Invention

The invention relates to a produce package and display. More particularly, the invention provides an herb vessel which can maintain the freshness of an herb prior to and after sale to a consumer. The invention also provides an herb display which can conveniently display herbs maintained in the herb vessels.

2. Discussion of the Background

It is becoming increasingly popular to cook with fresh herbs due to the improved flavor and texture which fresh herbs can provide, and the desire to utilize fresh, natural ingredients. Typically, fresh herbs are packaged in plastic or they are piled in bulk in the produce section of a supermarket so that the consumer can withdraw a portion from the produce section for purchase. However, the herbs can become dry or wilt before they are purchased and the supermarket must then discard unsold produce. Further, if the herbs deteriorate after purchase, the purpose of utilizing fresh herbs is defeated and the consumer either utilizes less than optimally fresh herbs and/or must discard unused portions. Such experiences can make the consumer less likely to purchase fresh herbs in the future. Further, where herbs are piled and sold from bulk in the supermarket produce section, the consumer can have concerns regarding the source of the herbs, as well as the cleanliness of the herbs as the herbs are left exposed and are handled by other consumers. In addition, the supermarket cashier must weigh the herb portions being purchased, and also must remember (or look up) a code corresponding to the price per pound of the herb being purchased, making the purchase transaction inefficient.

SUMMARY OF THE INVENTION

It is an object of the present invention to provide an improved herb container, and particularly a novel herb vessel which prolongs the freshness of herbs. The packaging of the present invention is advantageous in that shrinkage, drying or wilting of the herbs is minimized and, in fact, the herbs can continue to grow even after they are purchased. In addition, the herbs can be displayed and maintained without refrigeration, and can further prolong the freshness of the herbs if they are refrigerated. A further object of the invention is to provide a novel herb vessel package and a display for plural herb vessels such that a plurality of packages of fresh herbs can be conveniently shipped and displayed.

The present invention achieves the above and other advantages by packaging herbs utilizing a vessel or tube which is partially filled with water. A lid closes the top of the vessel to reduce spillage of the water. Preferably, the lid is flexible or elastic and includes an opening through which the stems of the herbs can be inserted so that the stems are held in the water of the herb vessel. By packaging the herbs with their stems in the water of the herb vessel, the herbs are hydrated and their freshness is greatly prolonged. In a particularly preferred form of the invention, a cellophane wrapper is also provided about the leafy portions of the herbs, so that the portions of the herbs which are disposed outside of the vessel are protected in the cellophane. The cellophane assists in preventing damage to the herbs and also in maintaining the cleanliness of the herbs and the perception of cleanliness. The cellophane also provides a convenient location at which a label can be affixed so that the consumer is provided with information concerning the origin of the herbs to thereby further promote consumer confidence. Moreover, by packaging herbs in accordance with the present invention, the herbs can be sold in predetermined amounts, so that a price can be placed upon the label (in the form of a set price amount and/or a price which can be scanned, e.g., utilizing a bar code). As a result, fresh herbs can be more conveniently purchased.

In a particularly preferred form, a display base/carton is provided which includes a number of mounting sites into which the herb vessels can be inserted. The display base is convenient for shipping and displaying the herb vessels. A number of display cartons can be shipped together and then removed from a pallette or box when received at the supermarket. The display bases can then be placed at a convenient location in the produce section so that a number of filled herb vessels can be displayed at a time. The consumer can then conveniently remove an herb vessel from the display for purchase.

The herb vessel of the invention maintains the freshness of the herbs while on display in the supermarket produce section and also after the consumer has purchased the herbs. The prolonged freshness can be achieved with or without refrigerating the herbs. In fact, the herbs can continue to grow after they have been purchased. By way of example, utilizing the herb container of the present invention, the freshness of basil has been maintained for up to thirty days simply by periodically adding or replacing the water within the vessel so that the stems of the herbs are maintained within a reservoir of water inside the vessel.

In addition to improved freshness, a further advantage of the herb container/packaging of the present invention is that the display and purchase of the herbs is less time consuming. In particular, the display is less time consuming for supermarket personnel, since a full display base, including a plurality of herb containers, can simply be removed from a carton or pallette and placed at a suitable display location within the supermarket without requiring unloading of bulk herbs into a display bin or further packaging of the herbs into consumersized packages. The purchase of herbs is also more convenient for the consumer since the consumer can simply remove a prepackaged portion of herbs contained in a herb vessel, without having, to bag a portion from a bulk. Further, the cashier can simply enter or scan the price of the herb upon check-out without having to weigh the herbs and without having to remember a price code.

BRIEF DESCRIPTION OF THE DRAWINGS

Other objects and advantages of the present invention will become readily apparent as the same becomes better understood with reference to the following detailed description, particularly when considered in conjunction with the drawings in which.

DESCRIPTION OF THE PREFERRED EMBODIMENTS

Figure 1:
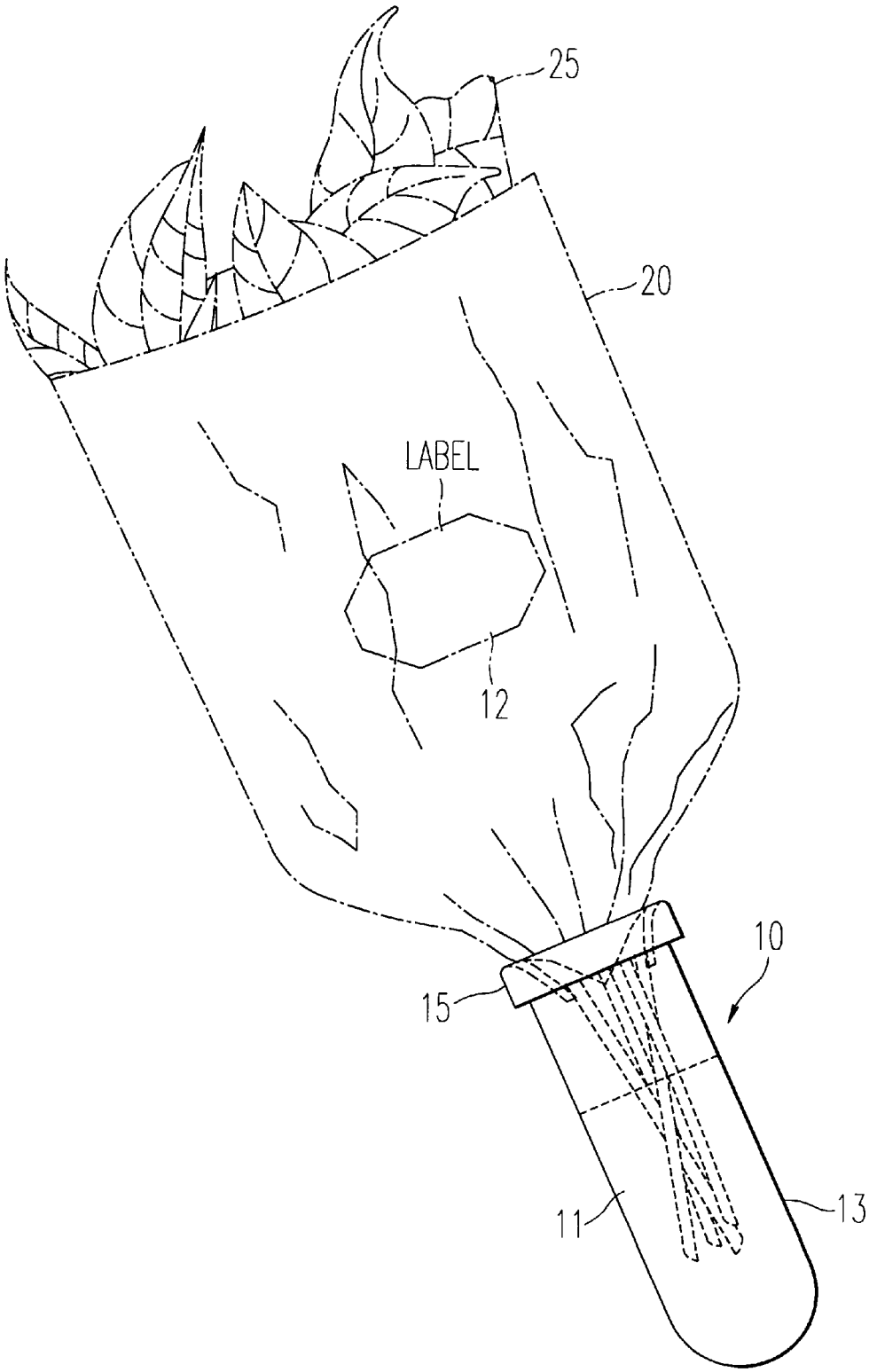
FIG. 1 depicts an herb vessel/package of the invention.

Referring now to the drawings, FIG. 1 shows an herb vessel 10 according to the invention. The herb vessel 10 includes a tube or vessel portion 13 and a lid 15. The herb vessel 10 provides a container which can be partially filled with water 11. As shown in FIG. 1, the herbs 25 are held by the lid of the vessel so that the stems of the herbs extend down into the vessel or tube portion 10, while the remainder of the herbs, i.e., the leafy portions, extend out of the vessel. In a preferred form of the invention, a wrap, such as cellophane 20 is disposed about the herbs to fully or at least partially wrap the portions of the herbs which are not disposed in the herb vessel and thereby protect the herbs from damage and dirt. The cellophane also provides a convenient location at which a label 12 can be affixed, to denote the source of the herbs (e.g., the grower or the distributor of the herbs). In addition, the label 12 can include price information in the form of a printed price and/or a scannable price code. It is to be understood that while a cellophane wrapping is shown in the preferred form of the invention of FIG. 1, the herb vessel of the present invention can also be utilized without cellophane wrapping. In addition, the label 12 denoting the source of the herbs can be provided upon the tubular/vessel portion of the package in addition to, or as an alternative to, the provision of a label upon the cellophane wrap.

In accordance with the present invention, the stems of the herbs 25 are held inside of the water containing vessel so that the water can hydrate the herbs as the stems draw water up into the upper leaf portions of the herbs 25. Thus, the package prevents drying, wilting, or shrinkage of the herbs. As a result, the freshness and shelf life of the herbs is significantly prolonged as compared with prior handling and packaging techniques. In fact, as mentioned earlier, the herbs can actually continue to grow after they have been purchased by a consumer. Although the present invention can be utilized for various herbs, advantageous results have been particularly noticed with herbs having well defined root or stem structures such as basil, arugula, chives, cilantro, dill, tarragon, sage, rosemary, parsley, thyme, marjoram, oregano and mint. The vessel package and display of the present invention can also be advantageously utilized for produce/agricultural products other than fresh herbs, such as plant cuttings, cut flowers, etc.

Figure 2:
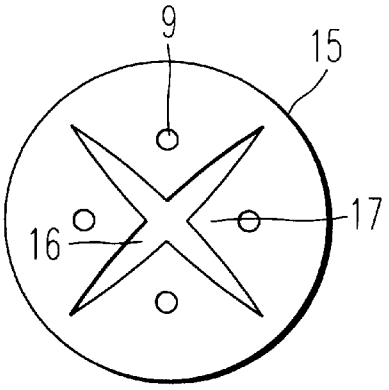
FIG. 2 depicts a lid portion of the herb vessel of FIG. 1.

FIG. 2 is a top view of an example of a lid configuration which can be advantageously utilized in accordance with the present invention. Preferably, the lid 15 is formed of a flexible or elastic material and includes an opening 16 through which the stems of the herbs can be inserted. In the embodiment shown in FIG. 2, a pair of slots are provided which intersect one another to form an X-shaped opening. However, it is to be understood that a single slot or other opening shapes could be provided within the scope of the present invention. With the lid formed of an elastic material, the stems of the herbs can be inserted through the opening. In the FIG. 2 arrangement, the slots define elastically deformable projections 17, which deform during insertion of the herbs and once inserted the projections 17 are held snugly against the stems of the herbs, thereby assisting in holding the herbs within the vessel and also in reducing spillage of the water through the lid. The use of an elastic lid material also assists in maintaining a tight seal of the lid about the periphery of the top of the container to thereby further assist in preventing the water from leaking or spilling from the container.

If it is desired to utilize a cellophane wrap for the leaf portions of the herbs, the herbs are preferably first wrapped in the cellophane, leaving the lowermost stem portions of the herbs exposed. The stems of the wrapped herbs can then be inserted through the opening 16 of the lid of the vessel so that the lowermost portions of the stems extend into the water of the herb vessel. Preferably, the wrapped herbs are inserted so that part of the cellophane extends through the lid opening and the elastic lid can additionally assists in holding the cellophane in place.

Figure 3:
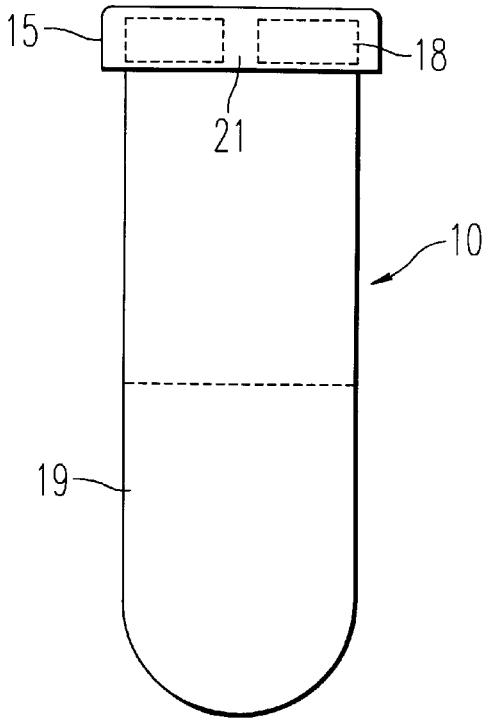
FIG. 3 depicts an alternate embodiment of the herb vessel of the invention.

Referring to FIG. 3, an herb vessel in accordance with the present invention is shown, with the herbs omitted for improved clarity. FIG. 3 additionally shows optional modifications which can be implemented as desired. As discussed above, the lid 15 is preferably formed of a deformable or elastic material. Preferably, the vessel or tubular portion 10 is formed of a rigid plastic material for structural integrity. Further, as shown in broken line in FIG. 3, one or more sponge or oasis-type materials can be utilized to hold water and further prevent spillage. For example, as shown at 18 in FIG. 3, a disk-shaped sponge or oasis-type material 18 can be provided in a top portion of the container so that should the container be tipped during shipping, the disk 18 will prevent seepage of the water through the opening in the lid or between the edges of the top of the container and the lid. The disk 18 can include a slot or opening 21 through which the stems of the herbs can be inserted to maintain the lowermost portions of the stems within the water of the container. The disk 18 can be held in place by any suitable expedient, for example, by adhering the disk to the lid 15 or the vessel 10, or by relying upon the elasticity of the disk 18 hold the disk 18 against the inner periphery of the vessel. As with the lid discussed earlier, the opening 21 will preferably deform during insertion of the stems so that the opening 21 is held snugly about the stems after they are inserted into the container. As also shown in FIG. 3, a sponge or oasis-type material insert 19 can also be disposed within the container 10 so that even when the container is not maintained vertically, the water will be held by the sponge or oasis-type material. If desired, the insert 19 can also be formed with an opening therein to receive the stems of the herbs. It is to be understood that the disk 18 and insert 19 are optional and that one, both, or neither of the disk 18 and insert 19 can be utilized in accordance with the present invention. Where both a disk 18 and an insert 19 are provided, they can be formed of the same or different materials (e.g., a sponge or foam-like material for the disk 18 and an oasis-type material for the insert 19). In addition, while a test tube-like shape is shown in FIG. 3, the vessel 10 can be of various shapes, including a square or flat-bottomed shape. A flat-bottomed shape can be advantageous in that the container is more conveniently held upright when sitting upon a flat surface or in a refrigerator. However, a test tube shape can be advantageous in assisting insertion of the container into a display base as discussed below.

Figure 4:
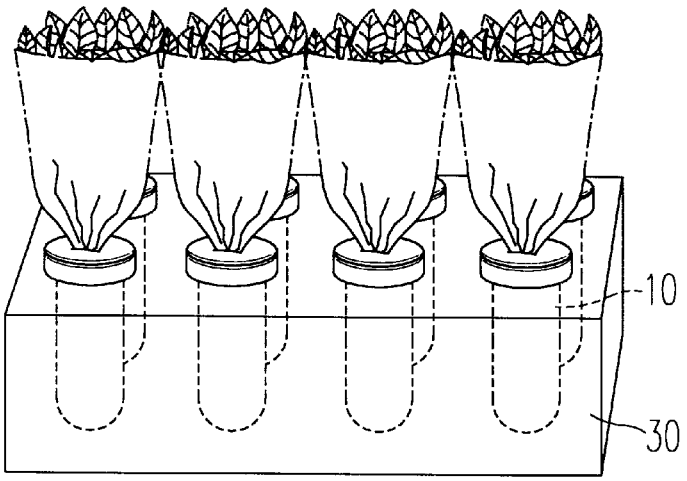
FIG. 4 depicts a display of a plurality of herb vessels disposed within a display base of the invention.

As shown in FIG. 4, in accordance with an advantageous aspect of the present invention, a display base is utilized for holding a plurality of herb vessels. For example, as shown in FIG. 4, the base 30 can have a row of four herb containers, and further, the base can hold a plurality of rows (with additional rows behind the front row shown in FIG. 4). The base 30 can be formed of corrugated cardboard, including four sidewalls and a top wall, with the top wall of the cardboard having a plurality of openings corresponding to the number of herb vessels which are to be inserted into the openings. As discussed earlier, utilizing a tapered or test tube shaped vessel, the vessel can be readily inserted into the openings of the base 30. The openings of the display base are preferably of the same approximate size as the largest diameter of the vessel 10. The openings of the display can actually be slightly smaller than the largest outer dimension of the vessels 10 since upon insertion of the vessels the cardboard base will deform slightly and hold the vessels snugly in place for shipping and display. Further, the openings of the base are preferably smaller than the diameter of the lid 15, so that the herb vessels will not fall through the display openings and at least the top of the herb vessel is maintained above the top of the display base 30.

As should be readily apparent, the display base allows for convenient shipping and display of a plurality of herb vessels. For shipping, one or more display bases can be inserted into a carton for transport and upon arrival at the point of sale, the display bases can be removed and placed at a desired display location. The display base, even when filled with plural herb containers, is sufficiently light so that a display can be positioned above other produce, even relatively gentle produce such as tomatoes. Thus, a consumer purchasing other produce can be enticed by the availability of fresh herbs such as basil to complement other produce. Thus, the present invention prolongs the freshness of herbs or other produce items, and makes it more convenient for such produce to be shipped, displayed, sold and maintained by the consumer after sale. In addition, the container and display of the present invention can enhance the sales of products such as herbs due to the improved consumer satisfaction, the ease with which such products can be purchased, the ability to display such products with other products, and the increased consumer confidence resulting from the prolonged freshness, perception of cleanliness and ability to designate a source of the produce. Accordingly, it should be recognized that the present invention is advantageous in numerous respects as compared with prior sales and handling arrangements for produce such as fresh herbs.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A plant item packaging, comprising:

a vessel portion to hold a liquid and to receive stems of a plant item;

a lid placed on top of the vessel portion, the lid including an opening configured to pass the stems of the plant item therethrough into the vessel; and a wrapping outside of the vessel, wherein a portion of the wrapping extends through the opening of the lid into the vessel.

2. A plant item packaging according to claim 1, wherein the lid includes a plurality of flexible projections projecting into the opening configured to hold the stems of the plant item.

3. A plant item packaging according to claim 1, further comprising a sponge formed at a bottom of the vessel.

4. A plant item packaging according to claim 1, further comprising a sponge formed at a top of the vessel, the sponge including an opening aligned with the opening of the lid.

5. A plant item packaging according to claim 1, wherein the lid is formed of an elastic material.

6. A plant item packaging according to claim 1, further comprising a label affixed to one of the wrapping and the vessel.

7. A plant item packaging according to claim 6, wherein the label contains information of at least one of an identification of the plant item and price information of the plant item.

8. A plant item packaging, comprising:

a vessel at least partially filled with water;

a lid placed on a top of the vessel, the lid including an opening;

a plant item having stems passing through the opening of the lid into the vessel at least partially filled with water; and a wrapping around a part of an upper portion of the plant item outside of the vessel, wherein a portion of the wrapping extends through the opening of the lid into the vessel.

9. A plant item packaging according to claim 8, wherein the lid includes a plurality of flexible projections projecting into the opening configured to hold the stems of the plant item.

10. A plant item packaging according to claim 8, further comprising a sponge formed at a bottom of the vessel.

11. A plant item packaging according to claim 8, further comprising a sponge formed at a top of the vessel, the sponge including an opening aligned with the opening of the lid.

12. A plant item packaging according to claim 8, wherein the lid is formed of an elastic material.

13. A plant item packaging according to claim 8, further comprising a label affixed to one of the wrapping and the vessel.

14. A plant item packaging according to claim 13, wherein the label contains information of at least one of an identification of the plant item and price information of the plant item.

15. A plant item packaging according to claim 8, wherein the plant item is an herb selected from the group consisting of basil, arugula, chives, cilantro, dill, tarragon, sage, rosemary, parsley, thyme, marjoram, oregano and mint.

16. A plant item packaging comprising:

a base including a plurality of holes;

a plurality of plant item vessels positioned in respective of said plurality of holes of said base, each plant item vessel comprising:

a portion configured to hold a liquid and to receive stems of a plant item;

a lid placed on a top of the portion, the lid including an opening configured to pass the stems of the plant item therethrough into the portion; and a wrapping around a part of an upper portion of the plant item outside of the vessel, wherein a portion of the wrapping extends through the opening of the lid into the vessel.

17. A plant item packaging according to claim 16, wherein in each plant item vessel the lid includes a plurality of flexible projections projecting into the opening configured to hold the stems of the plant item.

18. A plant item packaging according to claim 16, each plant item vessel further comprising a sponge formed at a bottom of the vessel.

19. A plant item packaging according to claim 16, each plant item vessel further comprising a sponge formed at a top of the vessel, the sponge including an opening aligned with the opening of the lid.

20. A plant item packaging according to claim 16, wherein in each plant item vessel the lid is formed of an elastic material.

21. A plant item packaging according to claim 14, each plant item vessel further comprising a plant item with stems passing through the opening of the lid into the portion, the portion being at least partially filled with water as the liquid.

22. A plant item packaging according to claim 16, further comprising a label affixed to one of the wrapping and the vessel.

23. A plant item packaging according to claim 16, wherein the label contains information of at least one of an identification of the plant item and price information of the plant item.

24. A plant item packaging according to claim 16, wherein the plant item is an herb selected from the group consisting of basil, arugula, chives, cilantro, dill, tarragon, sage, rosemary, parsley, thyme, marjoram, oregano and mint.

25. An herb packaging, comprising:

a vessel at least partially filled with water;

a lid placed on a top of the vessel, the lid including an opening;

an herb having stems passing through the opening of the lid into the vessel at least partially filled with water; and a wrapping around a part of an upper portion of the herb outside of the vessel, wherein a portion of the wrapping extends through the opening of the lid into the vessel.

26. An herb packaging according to claim 25, wherein the lid includes a plurality of flexible projections projecting into the opening configured to hold the stems of the herb.

27. An herb packaging according to claim 25, further comprising a sponge formed at a bottom of the vessel.

28. An herb packaging according to claim 25, further comprising a sponge formed at a top of the vessel, the sponge including an opening aligned with the opening of the lid.

29. An herb packaging according to claim 25, wherein the lid is formed of an elastic material.

30. An herb packaging according to claim 25, further comprising a label affixed to one of the wrapping and the vessel.

31. An herb packaging according to claim 30, wherein the label contains information of at least one of an identification of the herb and price information of the herb.

32. An herb packaging according to claim 25, wherein the herb is selected from the group consisting of basil, arugula, chives, cilantro, dill, tarragon, sage, rosemary, parsley, thyme, marjoram, oregano and mint.

33. An herb packaging comprising:

a base including a plurality of holes;

a plurality of herb vessels, each herb vessel being positioned in a respective one of said plurality of holes of said base, each herb vessel comprising:

a portion configured to hold a liquid and to receive stems of an herb;

a lid placed on a top of the portion, the lid including an opening configured to pass the stems of the herb therethrough into the portion; and a wrapping around a part of an upper portion of the herb outside of the vessel, wherein a portion of the wrapping extends through the opening of the lid into the vessel.

34. An herb packaging according to claim 33, wherein in each herb vessel the lid includes a plurality of flexible projections projecting into the opening configured to hold the stems of the herb.

35. An herb packaging according to claim 33, each plant item vessel further comprising a sponge formed at a bottom of the vessel.

36. An herb packaging according to claim 33, each plant item vessel further comprising a sponge formed at a top of the vessel, the sponge including an opening aligned with the opening of the lid.

37. An herb packaging according to claim 33, wherein in each herb vessel the lid is formed of an elastic material.

38. An herb packaging according to claim 33, each herb vessel further comprising an herb with stems passing through the opening of the lid into the portion, the portion being at least partially filled with water as the liquid.

39. An herb packaging according to claim 38, further comprising a label affixed to one of the wrapping and the vessel.

40. An herb packaging according to claim 39, wherein the label contains information of at least one of an identification of the herb and price information of the herb.

41. An herb packaging according to claim 38, wherein the herb is selected from the group consisting of basil, arugula, chives, cilantro, dill, tarragon, sage, rosemary, parsley, thyme, marjoram, oregano and mint.

* * * * *